US010040609B2

(12) United States Patent
Otsuka et al.

(10) Patent No.: US 10,040,609 B2
(45) Date of Patent: Aug. 7, 2018

(54) REFILL CONTAINER

(71) Applicant: TOPPAN PRINTING CO., LTD., Tokyo (JP)

(72) Inventors: Hiroyuki Otsuka, Tokyo (JP); Kenichirou Imai, Tokyo (JP); Youko Koide, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 68 days.

(21) Appl. No.: 14/671,175

(22) Filed: Mar. 27, 2015

(65) Prior Publication Data

US 2015/0197379 A1 Jul. 16, 2015

Related U.S. Application Data

(63) Continuation of application No. PCT/JP2013/076827, filed on Oct. 2, 2013.

(30) Foreign Application Priority Data

Oct. 3, 2012 (JP) ..... 2012-221167

(51) Int. Cl.
*B65D 35/00* (2006.01)
*B65D 47/10* (2006.01)
*B65D 75/58* (2006.01)

(52) U.S. Cl.
CPC ..... *B65D 47/10* (2013.01); *B65D 75/5822* (2013.01); *B65D 75/5866* (2013.01)

(58) Field of Classification Search
CPC . B65D 47/10; B65D 75/5822; B65D 75/5866
(Continued)

(56) References Cited

U.S. PATENT DOCUMENTS 2,093,974 A * 9/1937 Farmer ..... B65D 77/12 383/202
2,105,798 A * 1/1938 Tobiasson ..... B65D 17/163 220/270

(Continued)

FOREIGN PATENT DOCUMENTS

JP 4-327139 11/1992
JP 5-132069 5/1993

(Continued)

OTHER PUBLICATIONS

International Search Report dated Jan. 7, 2014 in corresponding international application PCT/JP2013/076827.

(Continued)

*Primary Examiner* — Patrick M Buechner
*Assistant Examiner* — Michael J Melaragno

(57) ABSTRACT

A refill container includes one sheet of lamination body having a base material and a sealant layer and a pouring nozzle seal portion, where the lamination body is folded such that the sealant layer is arranged inward, a peripheral portion of the surface lamination body and the rear surface lamination body is sealed, the bend portion together with the surface lamination body, the rear surface lamination body, and the pouring nozzle seal portion forms a pouring nozzle which pours a content, a tip of the pouring nozzle is sealed by a pouring-nozzle tip seal portion, the pouring-nozzle tip seal portion is detached along an opening line to form a pouring opening, an easily cutting processing which forms a plurality of half-cutting lines parallel to the opening line is performed, and the plurality of half-cutting lines is broken at a ridge line of the bend portion.

10 Claims, 7 Drawing Sheets

(58) Field of Classification Search
USPC ..... 222/107, 541.6, 153.07, 541.9
See application file for complete search history.

(56) References Cited

U.S. PATENT DOCUMENTS 2,707,581 A * 5/1955 Kaplan ..... B65D 75/5811 222/107
RE24,251 E * 12/1956 Henning ..... B65D 75/5811 222/107
2,811,281 A * 10/1957 Donovan ..... B65D 5/76 206/229
3,278,085 A * 10/1966 Edward ..... B65D 75/5811 206/484
3,341,108 A * 9/1967 Kirk ..... B65D 75/5805 206/484
3,397,835 A * 8/1968 Henning ..... B65D 75/5816 383/200
3,412,918 A * 11/1968 Sherman ..... B65D 75/58 222/541.6
3,759,439 A * 9/1973 Cross ..... B65D 75/5816 383/200
3,873,018 A * 3/1975 Donnay ..... B65B 7/2864 156/187
4,437,593 A * 3/1984 Bullock, III ..... B65D 41/48 215/256
4,491,245 A * 1/1985 Jamison ..... B65D 75/5822 222/107
4,650,079 A * 3/1987 Tani ..... B65D 75/68 206/484
4,691,834 A * 9/1987 Bullock, III ..... B65D 41/485 215/232
4,732,275 A * 3/1988 Hambleton ..... B65D 5/065 229/216
4,815,617 A * 3/1989 Cullum ..... B65D 41/48 215/232
4,844,268 A * 7/1989 Bullock, III ..... B65D 41/485 215/256
4,911,316 A * 3/1990 Tackles ..... B65D 41/48 215/256
4,974,732 A * 12/1990 Sullivan ..... B65D 75/008 206/484
4,978,232 A * 12/1990 Dunton ..... B65D 75/5866 222/572
4,998,646 A * 3/1991 Sherman ..... B65D 75/008 222/107
5,018,646 A * 5/1991 Billman ..... B65D 75/5822 222/107
5,241,150 A * 8/1993 Garvey ..... B65D 75/5811 219/725
5,411,178 A * 5/1995 Roders ..... A47K 5/1215 222/105
5,795,071 A * 8/1998 Sasaki ..... B65D 75/5822 383/104
5,839,609 A * 11/1998 Zakensberg ..... B65D 75/32 206/484
6,209,754 B1 * 4/2001 Suzumi ..... B65D 33/007 222/107
6,244,467 B1 * 6/2001 Lewit ..... B65D 55/16 222/107
6,667,081 B1 * 12/2003 Aoki ..... B65D 75/5805 206/218
7,597,480 B2 * 10/2009 Kuge ..... B65D 31/10 383/120
8,181,823 B2 * 5/2012 Fukuizumi ..... B31B 19/84 206/484
8,485,400 B2 * 7/2013 Kawakami ..... B65D 75/5866 206/218
8,523,437 B2 * 9/2013 Strand ..... B65D 33/2591 383/210.1
8,720,749 B1 * 5/2014 Greco ..... B65D 75/5822 222/1
2002/0148855 A1 * 10/2002 Sokolsky ..... B65D 75/5822 222/107
2002/0195461 A1 * 12/2002 Redmond ..... A45D 34/04 222/107
2005/0063624 A1 * 3/2005 Goto ..... B65D 75/5805 383/205
2005/0067046 A1 * 3/2005 Furukawa ..... B65D 75/5822 141/18
2007/0175920 A1 * 8/2007 Takada ..... B65D 75/5822 222/107
2008/0233252 A1 * 9/2008 Manning ..... A61J 9/005 426/412
2008/0253700 A1 * 10/2008 Sh ..... B65D 33/08 383/205
2009/0129706 A1 * 5/2009 Otsuka ..... B65D 75/5866 383/42
2009/0134185 A1 * 5/2009 Kawakami ..... B65D 75/5822 222/107
2011/0042411 A1 * 2/2011 Kasai ..... B65D 75/5866 222/107
2011/0075954 A1 * 3/2011 Kumar ..... B65D 33/1658 383/204
2012/0195534 A1 * 8/2012 Kruse ..... B65D 33/2508 383/203
2013/0279832 A1 * 10/2013 Burri ..... B65D 75/5855 383/205
2014/0044381 A1 * 2/2014 Ulstad ..... B65D 75/5866 383/207
2014/0061235 A1 * 3/2014 Ankudinov ..... B65D 75/5805 222/107
2014/0197202 A1 * 7/2014 Soh ..... B65D 35/44 222/107

FOREIGN PATENT DOCUMENTS

| | | |
|---|---|---|
| JP | 11-236053 | 8/1999 |
| JP | 2003-327255 | 11/2003 |
| JP | 2004-99082 | 4/2004 |
| JP | 2008-81144 | 4/2008 |
| JP | 4110940 | 7/2008 |
| JP | 2011-255946 | 12/2011 |
| JP | 2011-255947 | 12/2011 |
| JP | 4910528 | 4/2012 |
| JP | 2012-176782 | 9/2012 |

OTHER PUBLICATIONS

European Office Action dated Mar. 31, 2017 in corresponding European Patent Application No. 13843599.5.

* cited by examiner

REFILL CONTAINER

CROSS REFERENCE TO RELATED APPLICATIONS

This application is a continuation application based on a PCT Patent Application No. PCT/JP2013/076827, filed Oct. 2, 2013, whose priority is claimed on Japanese Patent Application No. 2012-221167 filed Oct. 3, 2012, the entire contents of which are hereby incorporated by reference.

BACKGROUND OF THE INVENTION

Field of the Invention

The present invention relates to a refill container which accommodates toiletries such as a liquid detergent and fabric softener and food and the like such as cooking oil and instant coffee.

Description of the Related Art

Toiletries such as a liquid detergent and fabric softener and food and the like such as cooking oil and instant coffee are accommodated in a container therefor having a shape which is easy to use. Having a structure specific to features and uses of the contents, the container therefor is expensive. Therefore, when the content is empty, the content which is accommodated in a refill container is sold as a product in order to be able to use the container therefor repeatedly.

For example, regarding a container of the liquid detergent, the detergent has to be taken out by weighing the appropriate amount each time when using it. Therefore, in order to easily pour the detergent into a measuring cup, a rigid plastic container having a nozzle at a pouring opening portion is used as a repetitive-use container. As a refill container for the repetitive-use container, to replenish the contents, a container in which a pouring opening is formed in a flexible container made of a flexible packaging film, or a container in which a plug is attached to the flexible container is generally used.

Since the rigid repetitive-use container is designed to pour out easily, the repetitive-use container is not necessarily suitable for a refill operation to replenish the contents from the refill container to the repetitive-use container.

On the other hand, the refill container is also not necessarily suitable for a refill operation since a focus of manufacturing the refill container is to reduce the cost.

A refill container is proposed that can be opened using a nozzle provided in the repetitive-use container. In addition, a refill container is proposed that does not need to be manually held since the refill container is self-supporting during the refill operation. Such refill container without manual support includes a coupling member coupled to an opening portion of the repetitive-use container attachably and detachably and non-removably, and a container sealing member sealing the refill container body (see Japanese Unexamined Patent Application, First Publication No. 2004-99082).

In a refill container described in Japanese Unexamined Patent Application, First Publication No. 2004-99082, since two members which are a connect member and a container sealing member are used at a plug portion in order to connect a repetitive-use container and a refill container, the cost of the refill container increases. The structure described in Japanese Unexamined Patent Application, First Publication No. 2004-99082 is screwing the refill container into an opening portion of the repetitive-use container; therefore, the two members are reliably connected. On the other hand, however, there are drawbacks such that the handling is bothering and also the cost increases since the plug is provided.

In view of the cost, a packaging bag in which the periphery of two packaging films forming a front and a rear as shown in FIG. 8 is sealed is advantageous. Such refill packaging bag may be provided with a pouring opening portion having an arbitrary width which is commensurate with a diameter of the container. However, when forming the pouring opening portion by sealing the periphery portion of the two films forming a front and a rear, when pouring the content, the opening portion is pulled by the sealed ends. Therefore, the front and the rear films are in a pseudo-contact state, thereby the pouring opening is clogged or the pouring opening portion is bent easily, and the pouring opening portion is removed from the repetitive-use container during the refill operation.

In order to solve the problems such as the pouring opening is clogged or the pouring opening portion is bent, a lot of packaging bags are proposed such as inserting a part of a member which is different from a film into the pouring opening portion (see Japanese Unexamined Patent Application, First Publication No. H05-132069), and securing an opening area by expanding a film at the vicinity of the pouring opening portion to make a three-dimensional shape (see Japanese Patent Publication No. 4110940).

However, these packaging bags need processes such as attaching another member and performing a deep emboss processing. In addition, during the refill operation, it is not possible to align and stack the packaging bags orderly in the supply portion of the packaging bags. Furthermore, in the pouring opening portion where the two films forming the front and the rear are sealed, since seal portions are formed at both ends, an opening width is narrowed by the amount of the sealing portion, and a sufficient opening cannot be secured. If the sufficient opening cannot be secured, the time required to dispense the refill is longer.

In order to solve the problems described above, a packaging bag in which a film constituting the packaging bag is bent to form one side of the pouring opening portion and a sealing portion of the pouring opening portion is formed only at one side is proposed (see Japanese Unexamined Patent Application, First Publication No. H11-236053 and Japanese Patent Publication No. 4910528).

When the packaging bag has a film in which one side of the pouring opening portion is folded as disclosed in Japanese Unexamined Patent Application, First Publication No. H11-236053 and Japanese Patent Publication No. 4910528, the issues of closing of the pouring opening portion and a small opening area of the pouring opening portion are eliminated. However, as can be seen in the pouring opening portion of the flexible packaging bag as shown in Japanese Patent Publication No. 4910528, when the pouring opening portion is set to be oblique in consideration of the ease of pouring operation, the opening operability becomes unstable.

FIG. 9A is a diagram showing a flexible packaging bag described in Japanese Patent Publication No. 4910528, and FIG. 9B is an enlarged diagram showing a portion of a pouring opening thereof. Such flexible packaging bag includes at the pouring opening portion, a cut line a, a V-shaped notch b, and a wound processing c with a halftone dot shape provided so as to cover the cut line a. However, if the position of the V-shaped notch shifts, a tear of the packaging bag deviates from the cut line a, and it cannot be opened at the original position of the cut line a.

In Japanese Unexamined Patent Application, First Publication No. 2011-255947, as shown in FIG. 10, an opening line to provide a pouring opening is formed so as to incline with respect to the bend portion. On the opening line, an easily cutting processing forming a plurality of parallel wound lines is performed. Moreover, by bending the tip portion of the opening cutting line toward a direction parallel to the opening line, a refill container in which the opening operation of the pouring opening portion can be performed easily and reliably is proposed.

However, since the above-described refill container is rubbed or a hole is made by rubbing, having shock or the like are provided to the plurality of wound lines formed at the bend portion, a leakage may occur.

The present invention has been made in view of the above circumstances and provides a refill container which is capable of forming a pouring opening portion with a large area without using a separate member such as a plug.

In addition, it is provided a refill container in which an opening operation of the pouring opening portion can be performed easily and reliably, and which can prevent liquid leakage and the like due to scratching, rubbing or the like during the logistics process, handling and the like.

SUMMARY OF THE INVENTION

In the first aspect of the present invention, there is provided a refill container including one sheet of lamination body having a base material and a sealant layer and a pouring nozzle seal portion, where the lamination body is folded such that the sealant layer is arranged inward to form a bend portion, a surface lamination body, and a rear surface lamination body, a peripheral portion of the surface lamination body and the rear surface lamination body is sealed, the bend portion together with the surface lamination body, the rear surface lamination body, and the pouring nozzle seal portion forms a pouring nozzle which pours a content, a tip of the pouring nozzle is sealed by a pouring-nozzle tip seal portion, the pouring-nozzle tip seal portion is detached along an opening line to form a pouring opening, on the opening line and at a peripheral portion of the opening line, an easily cutting processing which forms a plurality of half-cutting lines parallel to the opening line is performed, and the plurality of half-cutting lines is broken at a ridge line of the bend portion.

According to the refill container of the first aspect, in the bend portion, since a broken portion is provided in the half-cutting lines, it is possible to prevent liquid leakage caused by the rubbing or tearing of the bend portion.

In the second aspect of the present invention, in the refill container according to the first aspect, more than or equal to a half of the plurality of half-cutting lines is broken at a ridge line of the bend portion.

In the third aspect of the present invention, in the refill container according to the second aspect, in the plurality of half-cutting lines, the broken half-cutting lines and the non-broken half-cutting lines are arranged alternatively.

In the fourth aspect of the present invention, there is provided a refill container including one sheet of lamination body comprising a base material and a sealant layer, and a pouring nozzle seal portion, where the lamination body is folded such that the sealant layer is arranged inward to form a bend portion, a surface lamination body, and a rear surface lamination body, a peripheral portion of the surface lamination body and the rear surface lamination body is sealed, the bend portion together with the surface lamination body, the rear surface lamination body, and the pouring nozzle seal portion forms a pouring nozzle which pours a content, a tip of the pouring nozzle is sealed by a pouring-nozzle tip seal portion, the pouring-nozzle tip seal portion is detached along an opening line to form a pouring opening, on the opening line, an easily cutting processing which forms one half-cutting line parallel to the opening line is performed, and the half-cutting line is broken at a ridge line of the bend portion.

In the fifth aspect of the present invention, in the refill container according to any one of the first to the fourth aspects, the half-cutting line or the half-cutting lines are broken when a distance from the ridge line of the bend portion is in a range of 1.0 mm or more and 4.0 mm or less.

In the sixth aspect of the present invention, in the refill container according to any one of the first to the fifth aspects, the refill container has a shape of a standing pouch including, a bottom tape which is formed by further folding such that the sealant layer is arranged outward, and a seal portion which comprises the bottom tape between the surface lamination body and the rear surface lamination body, and is sealed at a peripheral portion.

In the seventh aspect of the present invention, the refill container according to any one of the first to the sixth aspects further includes a filling opening portion which is formed by opening up a portion of the bend portion and is filled with a content.

According to the aspects of the present invention described above, the refill container is formed such that at least one sheet of lamination body including a base material and a sealant layer is folded such that the sealant layer is arranged inward to form a bend portion, a surface lamination body, and a rear surface lamination body, and a peripheral portion of the surface lamination body and the rear surface lamination body is sealed. Therefore, unlike the container or the like using a plastic bottle or a plug made of plastic, since the refill container can be manufactured by using only a lamination body for the soft packaging, the cost of manufacturing the refill container can be reduced.

According to the aspects of the present invention described above, one sheet of the lamination body is folded such that the sealant layer is arranged inward to form a bend portion, and the bend portion together with the surface lamination body, the rear surface lamination body, and the pouring nozzle seal portion forms a pouring nozzle which pours a content. Therefore, a pouring opening portion with large area can be secured. As a result, the refill operation can be performed smoothly and quickly. In addition, the pouring opening portion can be formed easily and reliably.

On the opening line and at a peripheral portion of the opening line, an easily cutting processing which forms a plurality of half-cutting lines parallel to the opening line is performed. One half-cutting line or a plurality of half-cutting lines is broken when a distance from the ridge line of the bend portion is in a range of 1.0 mm or more and 4.0 mm or less. Therefore, at the bend portion, the half-cutting lines are broken or density of the half-cutting lines is decreased. Therefore, at the bend portion, it is possible to prevent the lamination body from rubbing or tearing that causes liquid leakage. In addition, when the opening tab is lifted, a split of the lamination body increases along the opening line, and a pouring opening can be easily formed at a predetermined position.

According to the aspects of the present invention described above, in the plurality of half-cutting lines, when the broken half-cutting lines and the non-broken half-cutting lines are arranged alternatively at the vicinity of the bend portion, the density of the half-cutting lines decreases uniformly. Therefore, it is possible to prevent the liquid leakage and to form an easily cutting of the pouring opening portion easily.

According to the aspects of the present invention described above, the refill container has a shape of a standing pouch including a bottom tape which is formed by folding one sheet of lamination body including the base material and the sealant layer such that the sealant layer is arranged outward, and a structure of sealing a peripheral portion by inserting the bottom tape between the surface lamination body and the rear surface lamination body. Therefore, a refill container having a large capacity and being self-standing can be formed.

According to the aspects of the present invention described above, a filling opening portion for filling contents is formed by opening up a portion of the bend portion. In this case, even if a container has a shape in which another seal portion cannot be used as a filling opening portion, a stable filling operation can be performed.

According to the aspects of the present invention described above, when a nozzle of a repetitive-use container including a nozzle cap is inserted to a pouring nozzle, after the nozzle of the repetitive-use container is inserted to a pouring nozzle which is kept horizontally, the container is inclined such that the pouring nozzle is perpendicular. Therefore, the refill operation can be performed quickly. In other words, in the refill container, since the pouring opening portion opens naturally by the bending portion formed by folding one sheet of the lamination body, it is easy to insert the nozzle in the desired container. In addition, by designing the size of the pouring opening to fit into the nozzle, it is possible to form the pouring opening that matches the nozzle. Therefore, it is possible to perform the refill operation quickly by inclining the pouring nozzle to be perpendicular after inserting the nozzle of the repetitive-use container to the pouring nozzle held horizontally.

DETAILED DESCRIPTION OF THE PREFERRED EMBODIMENTS

Hereinbelow, a refill container according to the present invention is described in detail with reference to the drawings.

Figure 1:
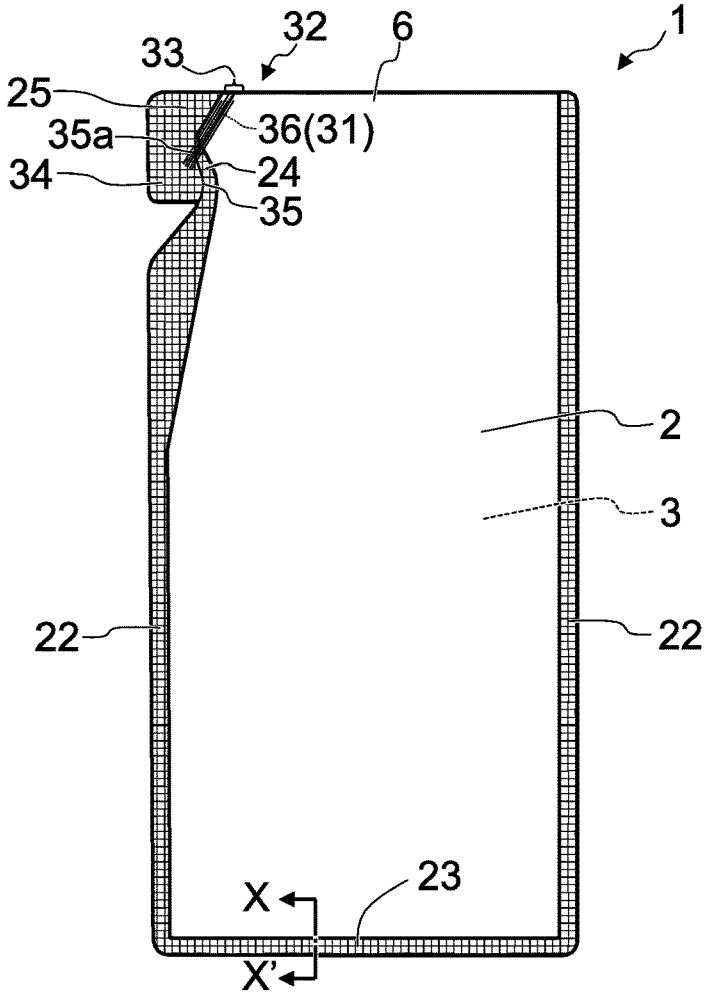
FIG. 1 is a schematic diagram showing a refill container according to one exemplary embodiment of the present invention.
Figure 2:
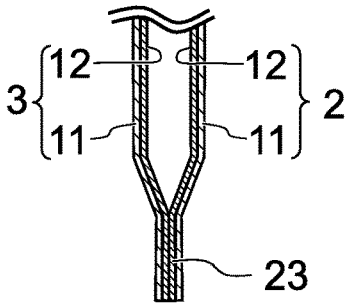
FIG. 2 is a schematic diagram of an X-X' cross-section of FIG. 1 showing a layer structure of a lamination body which configures the refill container.
Figure 3:
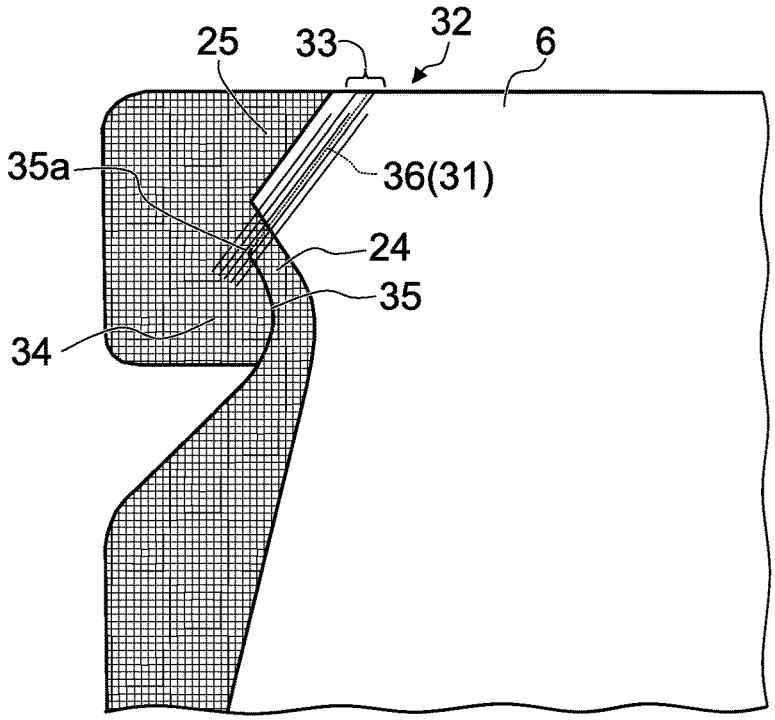
FIG. 3 is an enlarged diagram showing a detail of a pouring nozzle portion of FIG. 1.
Figure 4:
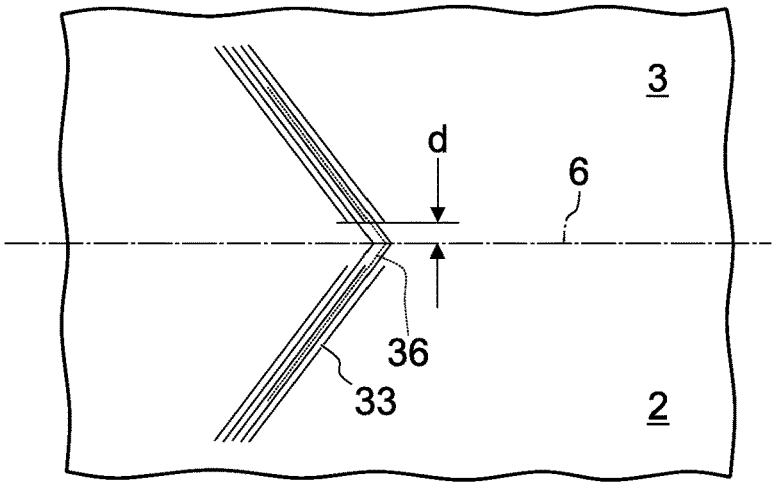
FIG. 4 is a schematic diagram showing a state where a folded portion of FIG. 3 is unfolded.

FIG. 1 is a schematic diagram showing a refill container according to one exemplary embodiment of the present invention. FIG. 2 is a schematic diagram of an X-X' cross-section of FIG. 1 showing a layer structure of a lamination body which configures the refill container. FIG. 3 is an enlarged diagram showing a detail of a pouring nozzle portion of FIG. 1, and FIG. 4 is a schematic diagram showing a state where a folded portion of FIG. 3 is unfolded.

A refill container 1 includes, as shown in FIG. 2, a lamination body having at least a base material 11 and a sealant layer 12. As shown in FIG. 1, in the refill container 1, a sheet of lamination body is folded such that the sealant layer 12 is arranged inward to form a bend portion 6, and a surface lamination body 2 and a rear surface lamination body 3 of a main body, and a peripheral portion of the surface lamination body 2 and the rear surface lamination body 3 is sealed.

The bend portion 6 together with the surface lamination body 2, the rear surface lamination body 3, and the pouring nozzle seal portion 24 forms a pouring nozzle 32 which pours the content. A tip of the pouring nozzle 32 is sealed by the pouring-nozzle tip seal portion 25. When the pouring-nozzle tip seal portion 25 is detached along an opening line 36, a pouring opening 31 is provided.

The opening line 36 is a single virtual line starting from an opening cutting line 35, passing through the surface lamination body 2, the bend portion 6, and the rear surface lamination body 3, and returning to the opening cutting line.

In the present exemplary embodiment, at the lower portion of the pouring-nozzle tip seal portion 25, an opening tab 34 divided by the opening cutting line 35 provided at the pouring nozzle seal portion 24 is formed. By splitting the pouring-nozzle tip seal portion 25 along the opening line 36 with holding the opening tab 34, the pouring opening 31 is provided (the detail thereof is not shown).

The opening line 36 is formed so as to incline with respect to the bend portion 6, and on the opening line and at a peripheral portion thereof, an easily cutting processing 33 which forms a plurality of half-cutting lines parallel to the opening line 36 is performed. A tip portion 35*a* of the opening cutting line 35 is bent toward a direction parallel to the opening line 36. In addition, the half-cutting lines are broken at the bend portion 6.

The refill container 1 according to one exemplary embodiment of the present invention, on the opening line 36 and at a peripheral portion thereof, an easily cutting processing 33 which forms a plurality of half-cutting lines parallel to the opening line 36 is performed. More than half of the half-cutting lines are broken when a distance d from the ridge line of the bend portion 6 is in a range of 1.0 mm or more and 4.0 mm or less.

Here, five half-cutting lines are formed from the surface lamination body 2 to the rear surface lamination body 3, and three of the half-cutting lines are broken over the distance d from the ridge line (a dashed line shown in FIG. 4) of the bend portion 6. The rest of two half-cutting lines are connected at the ridge line of the bend portion.

In addition, the broken half-cutting lines and the non-broken half-cutting lines are arranged alternatively. Therefore, density of the half-cutting lines at the bend portion 6 is decreased to a half or less of the original density. As a result, it is possible to prevent the bend portion 6, which is a top portion of the refill container 1, from rubbing or tearing that causes liquid leakage due to any causes occurred during transporting or handling the refill container 1.

Regarding the distance d from the ridge line of the bend portion 6 to a location where the half-cutting line is broken, if the distance d is too short, rubbing or tearing resistance is decreased, and if the distance d is too long, opening becomes difficult. Therefore, it is experimentally suitable that the distance d is in a range of 1.0 mm or more and 4.0 mm or less.

Figure 5:
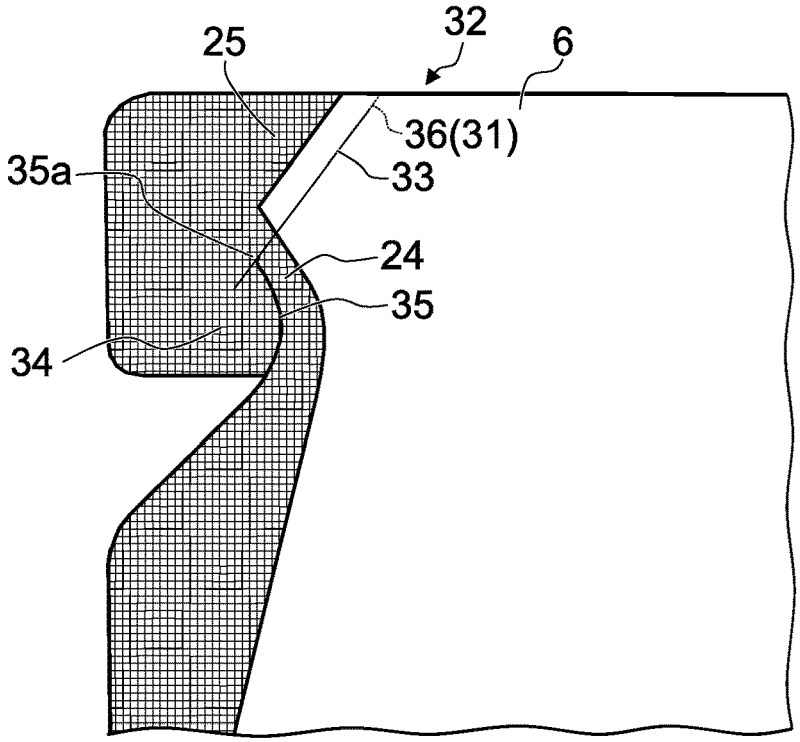
FIG. 5 is an enlarged diagram showing another exemplary embodiment of a pouring nozzle portion.
Figure 6:
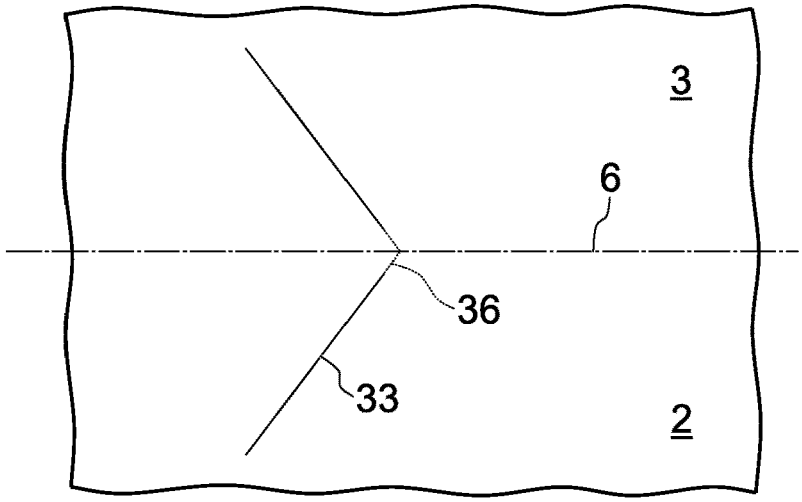
FIG. 6 is a schematic diagram showing a state where a folded portion of FIG. 5 is unfolded.

FIG. 5 is an enlarged diagram showing another exemplary embodiment of a pouring nozzle portion. FIG. 6 is a schematic diagram showing a state where a folded portion of FIG. 5 is unfolded.

In the exemplary embodiments shown in FIGS. 5 and 6, one half-cutting line is provided on the opening line 36, and the half-cutting line is broken at a ridge line of the bend portion 6. As described above, in the refill container 1 according to another exemplary embodiment of the present invention, an easily cutting processing 33 which forms one or more half-cutting lines parallel to the opening line 36 is performed. More than half of the half-cutting lines (in this case, one half-cutting line) are broken when a distance d from the ridge line of the bend portion 6 is in a range of 1.0 mm or more and 4.0 mm or less.

Here, the bend portion 6 of the refill container 1 is described in more detail. The bend portion 6 is formed such that a top portion of one sheet of lamination body is folded such that the sealant layer 12 is arranged inward. The bend portion 6 together with the surface lamination body 2, the rear surface lamination body 3, and the pouring nozzle seal portion 24 provided at a lower portion of the bend portion form a content discharge pass reaching the pouring opening 31. By the function of the elasticity of the lamination body in the bent portion 6, the cross-section of the discharge pass always has a swelled shape on the upper portion. Therefore, it is possible to keep a wide cross-sectional area of the pouring opening 31, and it is possible to discharge a large amount of contents at once.

In addition, in the exemplary embodiments shown in FIGS. 1-4, by splitting the pouring-nozzle tip seal portion 25 along the opening line 36 with holding the opening tab 34 divided by the opening cutting line 35 provided at the pouring nozzle seal portion 24, the opening line 31 is formed. The opening line 36 is formed so as to incline with respect to the bend portion 6, and on the opening line and at a peripheral portion thereof, an easily cutting processing 33 which forms a plurality of half-cutting lines parallel to the opening line 36 is performed. A tip portion 35*a* of the opening cutting line 35 is bent toward a direction parallel to the opening line 36. Therefore, the opening can be performed smoothly.

Figure 7:
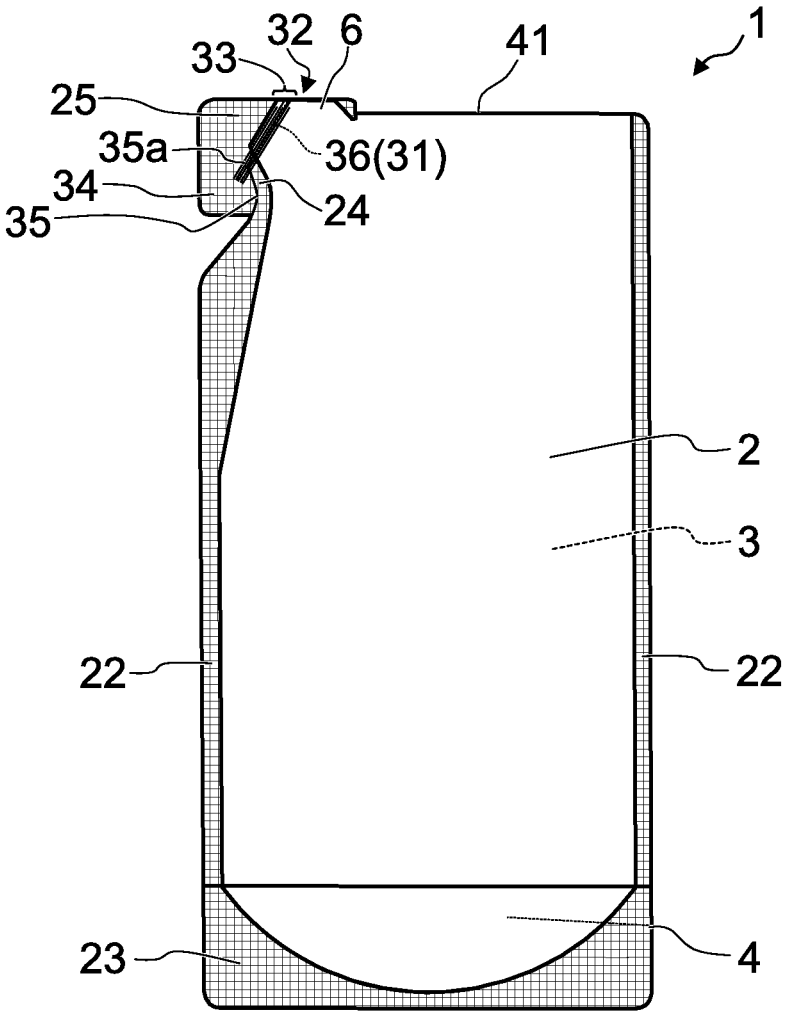
FIG. 7 is a schematic diagram showing a refill container according to another exemplary embodiment of the present invention.
Figure 8:
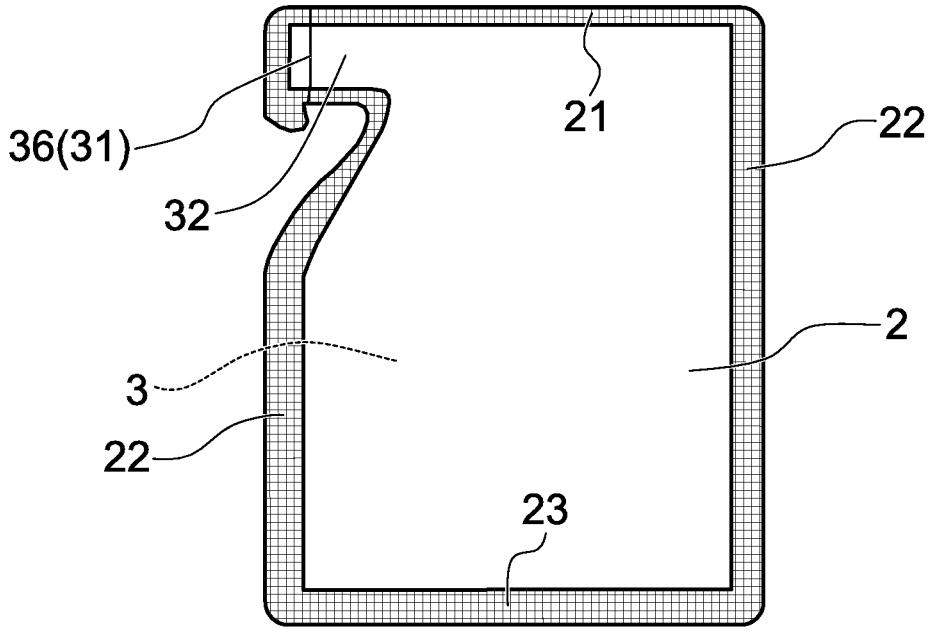
FIG. 8 is a schematic diagram showing a conventional refill container.
Figure 9A:
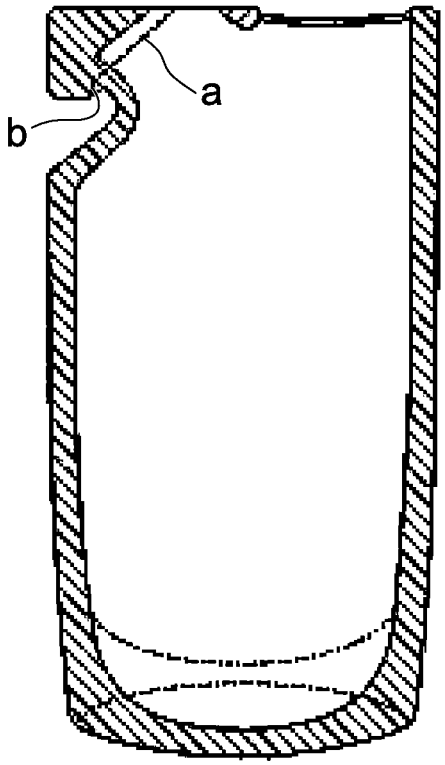
FIG. 9A is a schematic diagram showing a flexible packaging bag described in prior art.
Figure 9B:
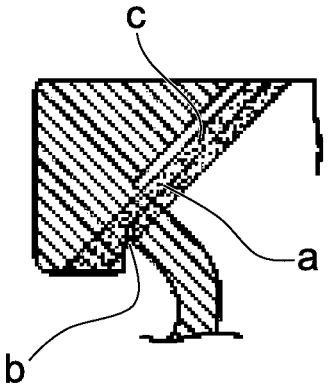
FIG. 9B is an enlarged diagram showing a detail of a pouring opening of the flexible packaging bag of FIG. 9A.
Figure 10:
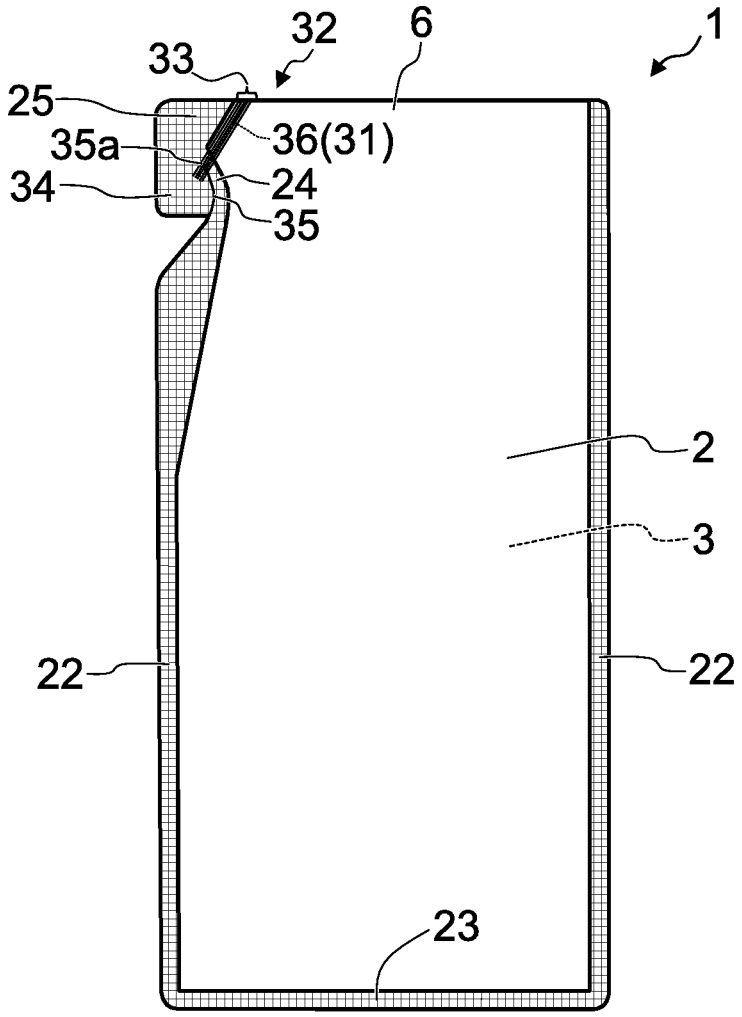
FIG. 10 is a schematic diagram showing a refill container described in prior art.

In the exemplary embodiment shown in FIG. 1, the surface lamination body 2 and the rear surface lamination body 3 are sealed at a side seal portion 22 and a bottom seal portion 23 to form a bag-shape. In a practical container, although a filling opening portion for filling the content is necessary, it is not shown in FIG. 1. In the exemplary embodiment shown in FIG. 1, a filling opening portion can be provided at the bottom seal portion 23 or the side seal portion 22. In addition, as shown in FIG. 7, the filling opening portion 41 can be formed by opening up a portion of the bend portion 6.

In addition, when the filling opening portion 41 is provided, the pouring nozzle is inserted to the filling opening portion 41 to fill the contents. In this case, since the filling opening portion 41 is expanded, there is a case where an end portion of the pouring nozzle side of the filling opening 41 is pulled and stretched. In order to prevent the stretch, it is preferable to provide a point seal at the end portion of the pouring nozzle side.

In the exemplary embodiment shown in FIG. 1, the bend portion 6 is formed horizontally at the upper portion of the refill container 1; however, the bend portion 6 can be formed vertically at a side surface of the refill container.

The opening line 36 is a virtual line showing an opening position; however, in order to show clearly the opening position, practically, printing descriptions and the like may be performed. In addition, easily cutting processing 33 is a half-cutting line provided on the outer surface of the surface lamination body 2 and the rear surface lamination body 3.

In order to form the half-cutting line, a method of forming the line using a cutter, and a method of forming the line by laser processing are generally used; however, if the method of forming the line by laser processing is used, it is possible to form a cut line more uniformly and stably. As a type of a laser, a carbon dioxide laser is preferable. Regarding an opening line 36, it is not perpendicular to the ridge line of the bent portion. By forming the opening line 36 to be inclined as shown in FIG. 1, the operability at the time of pouring is improved.

As a lamination body used for a refill container of the present exemplary embodiment, a lamination body generally used for a flexible packaging bag can be employed. As a base material 11, paper having one or more layers, a metal foil, or a synthetic resin film is appropriate. As an example, polyolefin-based resins such as a low-density polyethylene resin (LDPE), a high density polyethylene resin (HDPE), a linear low density polyethylene resin (LLDPE), a polypropylene resin (PP), and polyolefin-based elastomer; a polyester-based resin such as a polyethylene terephthalate resin (PET), a polybutylene terephthalate resin (PBT), and a polyethylene naphthalate resin (PEN); a cellulosic-based resins such as cellophane and cellulose triacetate (TAC); a synthetic resin film such as a polymethyl methacrylate (PMMA) resin, an ethylene-vinyl acetate copolymer resin (EVA), an ionomer resin, a polybutene-based resin, a polyacrylonitrile-based resin, a polyamide-based resin, a polystyrene-based resin (PS), a polyvinyl chloride-based resin (PVC), a polyvinylidene-based chloride resin (PVDC), a polycarbonate resin (PC), a fluorine-based resin, and an urethane-based resin; and paper, a plastic film or the like are used as a single body or a compounded body. In the base member 11, a printing layer, an adhesive layer and the like are included as needed.

As the above-described paper, fine quality paper, one-side art paper, coated paper, cast-coated paper, Japanese vellum or the like can be used. When paper is used for the lamination body, the paper may have fractures due to the deep embossing. Therefore, when paper is used for the refill container according to the present exemplary embodiment, as a convex emboss and a concave emboss, by forming streaky embosses, the lamination body using paper can be stably used. Moreover, in terms of environmental considerations, the use of paper is preferable.

As the sealant layer 12, a polyolefin-based resin is generally used. In particular, an ethylene-based resin such as a low density polyethylene resin, a medium density polyethylene resin, a linear low-density polyethylene resin, ethylene-vinyl acetate copolymer, and ethylene $\alpha$-olefin copolymer, and a polypropylene-based resin such as a homopolypropylene resin, propylene-ethylene random copolymer, propylene-ethylene block copolymer, and propylene α-olefin copolymer are used. Moreover, a multi-layer composite film of these resins can be used.

An example of a specific lamination structure is a film laminated such as in the order of: PET/print layer/adhesive layer/oriented polyamide resin film (hereinafter, abbreviated as ONY)/adhesive layer/LLDPE; ONY/adhesive layer/LLDPE; ONY/adhesive layer/ONY/adhesive layer/LLDPE, paper/LDPE/aluminum foil/LDPE; and paper/LDPE.

FIG. 7 is a schematic diagram showing a refill container 1 of another exemplary embodiment.

In the refill container 1 of the present exemplary embodiment, a standing pouch shape is formed such that the sheet of lamination body having at least a base material and a sealant layer is folded such that the sealant layer is arranged outward to form the bottom tape 4, the bottom tape 4 is inserted between the surface lamination body 2 and the rear surface lamination body 3, and the periphery thereof is sealed. In such a shape, since a filling opening portion with which the content is filled cannot be provided at the side seal portion, a portion of the bend portion 6 is opened up to form the filling opening portion 41. As described above, when an opening portion for filling is provided at a top portion of the container, the operation of filling the contents becomes easy.

Since a bottom tape 4 spreads in a container having a shape of a standing pouch, the container has a large capacity. Therefore, the pouring time using the refill container can be further decreased.

The bend portion 6 is formed such that a top portion of one sheet of lamination body is folded such that the sealant layer is arranged inward. The bend portion 6 together with the surface lamination body 2, the rear surface lamination body 3, and the pouring nozzle seal portion 24 form a content discharge pass reaching the pouring opening 31. As a result, particularly when the content is liquid, since the content smoothly flows through the linear discharge pass when pouring the content, it is possible to quickly pour the content out. The above-described configuration is more preferable in the present exemplary embodiment since the container of the present exemplary embodiment has a large capacity.

In order to manufacture the refill container 1 shown in FIG. 7, in the lamination body, which is slit to have a width approximately two times longer than a width corresponding to a height of the container, a top portion is folded such that the sealant layer surface is arranged inward and folded portions face each other to form the surface lamination body 2 and the rear surface lamination body 3. The surface lamination body 2 and the rear surface lamination body 3 are continuously provided, and the bottom tape 4 which is double-folded such that a surface of the sealant layer is arranged outward is continuously provided therebetween. Moreover, after necessary sealing is performed, the container is obtained by punching.

As described above, in the refill container according to the present exemplary embodiment, the pouring opening portion having a large area can be secured without using a particular plug and the like made of plastic. In addition, since a size of the pouring opening portion can be designed freely in accordance with a desired shape of the plug in the repeated-use containers, the refill container is useful as a dedicated refill container in which a refill operation can be performed quickly.

Hereinbelow, based on the examples, the refill container according to the present exemplary embodiment is described in more detail.

EXAMPLES

<Configuration of Surface Lamination Body and Rear Surface Lamination Body>

As the surface lamination body and the rear surface lamination body, a lamination body having a configuration described below was used:

PET (P60 manufactured by Toray Industries, Inc., 12 μm)/print layer/adhesive layer (TM 272 manufactured by Toyo-Morton, Ltd., 3 g/m$^2$(dry))/ONY (ONMB manufactured by Unitika Ltd., 15 μm)/adhesive layer (same as described above)/L-LDPE (T.U.X® FC-S manufactured by Mitsui Chemicals Tohcello, Inc., 150 μm).

<Configuration of Bottom Tape>

As the bottom tape, a lamination body having a configuration described below was used:

ONY (ONM manufactured by Unitika Ltd., 25 μm)/L-LDPE (same as described above, 120 μm).

With the lamination bodies described above, a standing pouch having a shape shown in FIG. 7 was manufactured. The size of a pouch was a width of 130 mm, height of 260 mm, and a bottom folding length of 35 mm. A width of the opening portion is approximately 18 mm.

A portion of the bend portion is cut to form a filling opening portion. In addition, on the opening line which forms a pouring opening portion of the pouring-nozzle tip portion, an easily cutting processing which forms a plurality of half-cutting lines by a laser processing as shown in FIGS. 3 and 4 is performed. The distance d was 2 mm. At the pouring nozzle seal portion, an opening cutting line is formed, and the tip portion of the opening cutting line is bent toward a direction parallel to the opening line.

When opening characteristics of the refill container obtained as described above were studied, it was possible to open in line with the opening line with a probability of 100%, and the pouring opening portion was stably formed. In addition, a transportation test was performed such that 10 packaging bodies after the filling were packed in a cardboard, and no liquid leakage due to rubbing, tearing or the like was occurred.

What is claimed is:

1. A refill container comprising one sheet of a lamination body comprising a base material and a sealant layer, and a pouring nozzle seal portion, wherein:

the lamination body is folded, such that the sealant layer is arranged inward, to form a bend portion, a surface lamination body, and a rear surface lamination body;

a peripheral portion of the surface lamination body and the rear surface lamination body is sealed;

the pouring nozzle seal portion is arranged at a lower portion of the bend portion;

the bend portion together with the surface lamination body, the rear surface lamination body, and the pouring nozzle seal portion arranged at the lower portion of the bend portion forms a pouring nozzle which is a discharge passage from which a content is poured;

a tip of the pouring nozzle is sealed by a pouring-nozzle tip seal portion, and the pouring-nozzle tip seal portion is detachable along an opening line to form a pouring opening;

a cross-sectional area of the bend portion has a swelled shape on an upper portion of the bend portion;

on the opening line and at a peripheral portion of the opening line, a plurality of half-cut lines parallel to the opening line has been formed by half-cutting;

the plurality of half-cut lines includes a plurality of broken half-cut lines that are broken at a ridge line of the bend portion and at a swelled portion in the cross-sectional area of the pouring opening; and the peripheral portion of the surface lamination body is divided along an opening cutting line that extends from an outer edge of the refill container to the half-cut line, the opening cutting line having a curvature that is convex toward an interior of the refill container, and the opening cutting line forming an opening tab in the peripheral portion.

2. The refill container according to claim 1, wherein the broken half-cut lines are at least half of the plurality of half-cut lines.

3. The refill container according to claim 2, wherein the plurality of half-cut lines further includes a plurality half-cut lines not broken at the ridge line, and the plurality of broken half-cut lines and the plurality of half-cut lines not broken at the ridge are alternately arranged.

4. A refill container comprising one sheet of lamination body comprising a base material and a sealant layer, and a pouring nozzle seal portion, wherein:

the lamination body is folded, such that the sealant layer is arranged inward, to form a bend portion, a surface lamination body, and a rear surface lamination body;

a peripheral portion of the surface lamination body and the rear surface lamination body is sealed;

the pouring nozzle seal portion is arranged at a lower portion of the bend portion;

the bend portion together with the surface lamination body, the rear surface lamination body, and the pouring nozzle seal portion arranged at the lower portion of the bend portion forms a pouring nozzle which is a discharge passage from which a content is poured;

a tip of the pouring nozzle is sealed by a pouring-nozzle tip seal portion, and the pouring-nozzle tip seal portion is detachable along an opening line to form a pouring opening;

a cross-sectional area of the bend portion has a swelled shape on an upper portion of the bend portion;

on the opening line, one half-cut line parallel to the opening line has been formed by half-cutting;

the half-cut line is broken at a ridge line of the bend portion and at a swelled portion in the cross-sectional area of the pouring opening; and the peripheral portion of the surface lamination body is divided along an opening cutting line that extends from an outer edge of the refill container to the half-cut line, the opening cutting line having a curvature that is convex toward an interior of the refill container, and the opening cutting line forming an opening tab in the peripheral portion.

5. The refill container according to claim 1, wherein the plurality of broken half-cut lines is broken across a distance from the ridge line of the bend portion that is in a range of 1.0 mm or more and 4.0 mm or less.

6. The refill container according to claim 4, wherein the half-cut line is broken across a distance from the ridge line of the bend portion that is in a range of 1.0 mm or more and 4.0 mm or less.

7. The refill container according to claim 1, wherein the refill container has a shape of a standing pouch comprising:

a bottom tape which is formed by further folding such that the sealant layer is arranged outward; and a seal portion which comprises the bottom tape between the surface lamination body and the rear surface lamination body, and is sealed at a peripheral portion.

8. The refill container according to claim 4, wherein the refill container has a shape of a standing pouch comprising:

a bottom tape which is formed by further folding such that the sealant layer is arranged outward; and a seal portion which comprises the bottom tape between the surface lamination body and the rear surface lamination body, and is sealed at a peripheral portion.

9. The refill container according to claim 1, further comprising a filling opening portion which is formed by opening up a portion of the bend portion and is filled with the content.

10. The refill container according to claim 4, further comprising a filling opening portion which is formed by opening up a portion of the bend portion and is filled with the content.

* * * * *